US009129733B2

(12) United States Patent
Sato

(10) Patent No.: US 9,129,733 B2
(45) Date of Patent: Sep. 8, 2015

(54) LAMINATED INDUCTOR ELEMENT AND MANUFACTURING METHOD THEREOF

(71) Applicant: Murata Manufacturing Co., Ltd., Nagaokakyo-shi, Kyoto-fu (JP)

(72) Inventor: Takako Sato, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 13/955,488

(22) Filed: Jul. 31, 2013

(65) Prior Publication Data

US 2013/0314194 A1 Nov. 28, 2013

Related U.S. Application Data

(63) Continuation of application No. PCT/JP2011/076986, filed on Nov. 24, 2011.

(30) Foreign Application Priority Data

Apr. 6, 2011 (JP) ..... 2011-084212

(51) Int. Cl.

| | |
|---|---|
| ***H01F 5/00*** | (2006.01) |
| ***H01F 27/24*** | (2006.01) |
| ***H01F 27/29*** | (2006.01) |
| ***H01F 27/30*** | (2006.01) |
| ***H01F 27/28*** | (2006.01) |

(Continued)

(52) U.S. Cl.

CPC ..... *H01F 17/0013* (2013.01); *H01F 41/046* (2013.01); *H01F 2017/0066* (2013.01)

(58) Field of Classification Search

CPC ..... H01F 17/0006; H01F 17/0013; H01F 27/2804

USPC ..... 336/200, 233, 234

See application file for complete search history.

(56) References Cited

U.S. PATENT DOCUMENTS 6,452,473 B1 * 9/2002 Suzuki et al. ..... 336/223
6,459,351 B1 * 10/2002 Maki et al. ..... 336/200

(Continued)

FOREIGN PATENT DOCUMENTS

EP 2 028 664 A1 2/2009
JP 1-35483 B2 7/1989

(Continued)

OTHER PUBLICATIONS

Official Communication issued in International Patent Application No. PCT/JP2011/076986 mailed on Feb. 28, 2012.

(Continued)

*Primary Examiner* — Elvin G Enad
*Assistant Examiner* — Kazi Hossain
(74) *Attorney, Agent, or Firm* — Keating & Bennett, LLP

(57) ABSTRACT

A laminated inductor element is configured to prevent warpage of the entire element with a structure in which a non-magnetic ferrite layer on an upper surface side is reduced in thickness to achieve a reduction in height of the entire element, a non-magnetic ferrite layer on a lower surface side is increased in thickness to be thicker than the non-magnetic ferrite layer so as to prevent a metal component diffused from a magnetic ferrite layer from coming into electrical contact with a land electrode of a mounting substrate, and an inductor is disposed toward the lower surface side across a non-magnetic ferrite layer.

11 Claims, 4 Drawing Sheets

(51) Int. Cl.
*H01F 17/00* (2006.01)
*H01F 41/04* (2006.01)

(56) References Cited

U.S. PATENT DOCUMENTS

| | | | | |
|---|---|---|---|---|
| 6,515,568 | B1 * | 2/2003 | Maki et al. | 336/200 |
| 6,864,774 | B2 * | 3/2005 | Kanetaka et al. | 336/83 |
| 7,839,651 | B2 * | 11/2010 | Nishizawa | 361/763 |
| 7,884,698 | B2 * | 2/2011 | Tanaka et al. | 337/297 |
| 8,058,964 | B2 * | 11/2011 | Sato | 336/232 |
| 8,410,887 | B2 * | 4/2013 | Nanjyo et al. | 336/200 |
| 8,810,352 | B2 * | 8/2014 | Yokoyama et al. | 336/200 |
| 2003/0076211 | A1 * | 4/2003 | Matsuta et al. | 336/200 |
| 2007/0182519 | A1 * | 8/2007 | Tsuzuki et al. | 336/200 |
| 2007/0222550 | A1 * | 9/2007 | Fujiwara et al. | 336/200 |
| 2008/0197963 | A1 * | 8/2008 | Muto | 336/200 |
| 2009/0068426 | A1 * | 3/2009 | Nishizawa | 428/209 |
| 2009/0251268 | A1 * | 10/2009 | Sato | 336/200 |
| 2010/0157565 | A1 * | 6/2010 | Yoshida et al. | 361/811 |
| 2011/0215893 | A1 * | 9/2011 | Nussbaum | 336/200 |

FOREIGN PATENT DOCUMENTS

| | | | |
|---|---|---|---|
| JP | 07-86754 | A | 3/1995 |
| JP | 10-270813 | A | 10/1998 |
| JP | 2000-252131 | A | 9/2000 |
| JP | 2004-235374 | A | 8/2004 |
| JP | 2005-175159 | A | 6/2005 |
| JP | 2005-183890 | A | 7/2005 |
| JP | 2008-109063 | A | 5/2008 |
| JP | 2009-152489 | A | 7/2009 |
| JP | 2009-170566 | A | 7/2009 |
| WO | 2007/145189 | A1 | 12/2007 |

OTHER PUBLICATIONS

Yokoyama et al., "Laminated Inductor Element and Manufacturing Method Thereof", U.S. Appl. No. 13/955,505, filed Jul. 31, 2013.
Official Communication issued in corresponding Japanese Patent Application No. 2012-531139, mailed on Jul. 22, 2014.
Official Communication issued in corresponding European Patent Application No. 11862903.9, mailed on Aug. 26, 2014.

* cited by examiner

LAMINATED INDUCTOR ELEMENT AND MANUFACTURING METHOD THEREOF

BACKGROUND OF THE INVENTION

1. Field of the Invention

The present invention relates to a laminated inductor element including a plurality of laminated sheets including a magnetic material and including coil patterns, and to a manufacturing method thereof.

2. Description of the Related Art

In the past, a laminated element having a plurality of laminated sheets has been known. The laminated element has an issue of warpage caused in the entire element by firing, due to the difference in thermal shrinkage rate among layers.

In view of this, Japanese Unexamined Patent Application Publication No. 2004-235374, for example, describes a laminated element having different types of materials alternately laminated to improve the flatness.

Further, Japanese Unexamined Patent Application Publication No. 2009-152489 indicates that a substantially thin low dielectric layer (glass) is disposed on an outermost layer on the mounting surface side to prevent the warpage.

In a laminated inductor element having a magnetic material formed with coil patterns and laminated, however, different types of materials (magnetic layers and non-magnetic layers, for example) are not allowed to be alternately laminated. Further, if a thin layer made of a material different from the material of the magnetic layers is disposed on an outermost layer, a metal component forming the coil patterns may be diffused into the magnetic material at an end surface of the laminated inductor element and cause an unintended short circuit with a mounting substrate.

SUMMARY OF THE INVENTION

In view of the above, preferred embodiments of the present invention provide a laminated inductor element and a manufacturing method thereof which prevent contact between the mounting substrate and the metal component diffused from the magnetic material and thus prevent unintended short circuits, while improving the flatness of the sheets.

A laminated inductor element according to a preferred embodiment of the present invention includes a magnetic layer defined by a lamination of a plurality of magnetic sheets, a non-magnetic layer formed by lamination of a plurality of non-magnetic sheets, and an inductor including coils provided between the laminated sheets and connected in a lamination direction. Further, the non-magnetic layer is disposed on outermost layers and in an intermediate layer of the body of the element, the non-magnetic layer on the outermost layer on one surface side and the non-magnetic layer on the outermost layer on the other surface side are different in thickness, and the inductor is disposed toward either one of the surface sides in the lamination direction across the non-magnetic layer provided in the intermediate layer.

As described above, in the non-magnetic layers on the outermost layers of the body of the element (laminate), the non-magnetic layer on either one of the surface sides has a reduced thickness to achieve a reduction in height of the entire element, and the non-magnetic layer on the other surface side is increased in thickness to significantly reduce or prevent the possibility of a metal component diffused into the magnetic material from coming into unintended electrical contact with a mounting substrate. As a result, short circuits are prevented. Further, since the inductor is disposed toward either one of the surface sides across the non-magnetic layer corresponding to the intermediate layer, it is possible to prevent warpage caused by the difference in thermal shrinkage rate. For example, in a case where the thermal shrinkage rate of the non-magnetic layer is lower than the thermal shrinkage rate of the magnetic layer, if the inductor having a further lower thermal shrinkage rate is disposed toward the surface side including the thick non-magnetic layer, it is possible to prevent the warpage of the entire element.

Further, in a preferred embodiment of the present invention, if the one surface side is mounted with an electronic component defining an electronic component module, and the other surface side is provided with a terminal electrode to be connected to a land electrode or the like of a mounting substrate of an electronic device, it is preferred that the non-magnetic layer on the one surface side is thinner than the non-magnetic layer on the other surface side.

If the laminated inductor element is mounted with an electronic component, such as an IC or a capacitor, to provide an electronic component module, an electrode is disposed on the upper surface of the laminated inductor element in consideration of the mounting of the IC or the capacitor. Therefore, an electrode of the IC or the capacitor is not larger than the electrode on the front surface of the element, and does not protrude from the upper surface of the element. In an electronic device product manufacturing process after the shipment of the laminated inductor element as the electronic component module, however, the mounting substrate to be mounted with the electronic component module includes a land electrode of various sizes. Thus, there is a case in which the land electrode of the mounting substrate is larger than the terminal electrode of electronic component module. In this case, solder applied to the land electrode of the mounting substrate may wet up, bring a metal component diffused toward a side surface of the laminated inductor element and the land electrode of the mounting substrate into electrical contact with each other, and cause an unintended short circuit. It is therefore preferable to increase the thickness of the non-magnetic layer on the surface side provided with the terminal electrode to be connected to the mounting substrate of the electronic device, to thus prevent, as much as possible, the contact between the diffused metal component and the land electrode of the mounting substrate.

In the above-described preferred embodiment of the present invention, to have the inductor disposed toward either one of the surface sides in the lamination direction across the non-magnetic layer provided in the intermediate layer, it is conceivable to configure, for example, a preferred embodiment in which the inductor is disposed toward the other surface side in the lamination direction across the non-magnetic layer provided in the intermediate layer. Further, a preferred embodiment may be configured in which the non-magnetic layer provided in the intermediate layer is disposed toward either one of the surface sides in the lamination direction. Further, a preferred embodiment may be configured in which the inductor is disposed toward the other surface side in the lamination direction across the non-magnetic layer provided in the intermediate layer, and in which the non-magnetic layer provided in the intermediate layer is disposed toward either one of the surface sides in the lamination direction.

Further, it is preferred in the above-described preferred embodiment of the present invention that the thicker one of the non-magnetic layers on the outermost layers is thicker than the depth of grooves that are provided to break the laminate. If the non-magnetic layer is thicker than the depth of the grooves to break the laminate, the magnetic layer is not exposed to the surface before breaking, and the metal component diffused by firing is not exposed to the surface.

Further, if the grooves to break the laminate are provided along two mutually perpendicular or substantially perpendicular directions and are different in depth between the two directions, the thicker non-magnetic layer may be made thicker than the depth of the shallower one of the grooves used to break the laminate.

Normally, in a plating process, a pre-break mother laminate is swung in a predetermined direction. A plating solution does not stagnate in the grooves provided in the same direction as the swing direction, and thus the diffused metal component is not grown by plating. In the direction perpendicular or substantially perpendicular to the swing direction, however, the plating solution tends to stagnate, and thus the diffused metal component is easily grown by plating. Therefore, it suffices if the non-magnetic layer is thicker than the grooves in the direction perpendicular or substantially perpendicular to the swing direction. Herein, if the grooves provided in the same direction as the swing direction are made deep, and the grooves provided in the direction perpendicular or substantially perpendicular to the swing direction are made shallow, it is possible to reduce the thickness of the non-magnetic layer as much as possible.

As to the laminated inductor element of a preferred embodiment of the present invention, description is made of a non-limiting example which preferably uses a ferrite containing iron, nickel, zinc, and copper as the magnetic layer, uses a ferrite containing iron, zinc, and copper as the non-magnetic layer, and uses a silver material, for example, as the inductor. In this case, the thermal shrinkage rate of the magnetic layer is higher than the thermal shrinkage rate of the non-magnetic layer, and the inductor has the lowest thermal shrinkage rate. With a preferred embodiment in which the inductor is disposed toward the lower surface side across the non-magnetic layer, therefore, it is possible to prevent the warpage of the entire element. A preferred embodiment in which the inductor is disposed conversely toward the upper surface side across the non-magnetic layer is also conceivable, depending on the difference in materials (e.g., difference in thermal shrinkage rate).

According to various preferred embodiments of the present invention, it is possible to prevent unintended electrical contact between the mounting substrate and the metal component diffused from the magnetic material and thus prevent short circuits, while improving the flatness of the substrates.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1A:
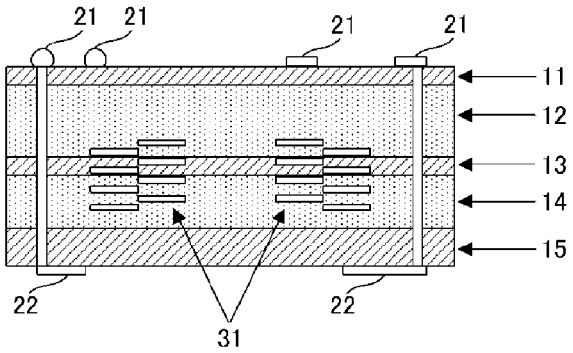
FIGS. 1A-1C are cross-sectional views of laminated inductor elements.

FIG. 1A is a cross-sectional view of a laminated inductor element according to a preferred embodiment of the present invention. The laminated inductor element is defined by lamination of magnetic ceramic green sheets and non-magnetic ceramic green sheets. In the cross-sectional view illustrated in the present preferred embodiment, the upper side of the drawing corresponds to the upper surface side of the laminated inductor element, and the lower side of the drawing corresponds to the lower surface side of the laminated inductor element.

The laminated inductor element in the example of FIG. 1A is defined by a laminate having a non-magnetic ferrite layer 11, a magnetic ferrite layer 12, a non-magnetic ferrite layer 13, a magnetic ferrite layer 14, and a non-magnetic ferrite layer 15 sequentially disposed from an outermost layer on the upper surface side toward an outermost layer on the lower surface side.

On some of the ceramic green sheets defining the laminate, internal electrodes including coil patterns are provided. The coil patterns are connected in the lamination direction to define an inductor 31. The inductor 31 in the example of FIG. 1A is disposed in the magnetic ferrite layer 12 on the upper surface side, the non-magnetic ferrite layer 13 corresponding to an intermediate layer, and the magnetic ferrite layer 14 on the lower surface side.

On the upper surface of the non-magnetic ferrite layer 11 (the uppermost surface of the element), outer electrodes 21 are provided. The outer electrodes 21 are mounted with an IC, a capacitor, and so forth. As a result, the laminated inductor element serves as an electronic component module (such as a DC-DC converter, for example).

Further, the lower surface of the non-magnetic ferrite layer 15 (the lowermost surface of the element) is provided with terminal electrodes 22. The terminal electrodes 22 serve as terminal electrodes to be connected to land electrodes or the like of a mounting substrate which is mounted with the electronic component module in an electronic device product manufacturing process after the shipment of the laminated inductor element as the electronic component module. The outer electrodes 21 and the terminal electrodes 22 are electrically connected by through vias.

The non-magnetic ferrite layer 13 corresponding to an intermediate layer functions as a gap between the magnetic ferrite layer 12 and the magnetic ferrite layer 14, and improves a direct-current superimposition characteristic of the inductor 31. The non-magnetic ferrite layer 13 in the example of FIG. 1A is disposed at the center of the laminated inductor element in the lamination direction.

The non-magnetic ferrite layer 11 and the non-magnetic ferrite layer 15 corresponding to the outermost layers cover the upper surface of the magnetic ferrite layer 12 and the lower surface of the magnetic ferrite layer 14, respectively, and prevent unintended short circuit due to a later-described diffused metal component.

Further, the non-magnetic ferrite layer 11 and the non-magnetic ferrite layer 15 of the present preferred embodiment are lower in thermal shrinkage rate than the magnetic ferrite layer 12 and the magnetic ferrite layer 14. If the magnetic ferrite layer 12 and the magnetic ferrite layer 14 having a relatively high thermal shrinkage rate are sandwiched by the non-magnetic ferrite layer 11 and the non-magnetic ferrite layer 15 having a relatively low thermal shrinkage rate, therefore, it is possible to compress the entire element and improve the strength thereof by firing.

Figure 2:
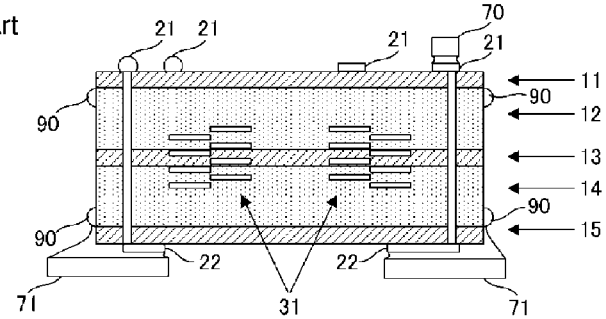
FIG. 2 Prior Art
FIG. 2 is a cross-sectional view of an existing laminate.

If materials of different thermal shrinkage rates are laminated and fired, however, stress in the lamination direction may be generated and cause warpage in the entire element. In the past, as illustrated in the example of FIG. 2, a non-magnetic ferrite layer has been disposed at the center in the lamination direction, and magnetic ferrite layers and non-magnetic ferrite layers have been symmetrically disposed in the lamination direction, to thereby maintain the stress balance of the entire element and prevent the warpage. However, if a non-magnetic ferrite layer of an outermost layer is reduced in thickness to achieve a reduction in height of the entire element, as illustrated in FIG. 2, a metal component 90 may be diffused from the magnetic ferrite layer 12 and the magnetic ferrite layer 14 in a firing process, grow in a plating process, and come into contact with land electrodes 71 of the mounting substrate via solder, and consequently, unintended short circuit may be caused. Specifically, as to electronic components mounted before shipment, such as an IC and a capacitor, upper surface electrodes of the laminated inductor element are provided in consideration of the mounting of the electronic components. Therefore, the area of an electrode 70 of the IC, the capacitor, or the like is not larger than the area of the corresponding outer electrode 21, and the electrode 70 does not protrude from the upper surface of the element. In the electronic device product manufacturing process after the shipment of the laminated inductor element as the electronic component module, however, the mounting substrate includes land electrodes of various sizes. Thus, there is a case where the area of a land electrode 71 of the mounting substrate is larger than the area of the corresponding terminal electrode 22. In this case, it is highly possible that the solder on the land electrode 71 wets up, comes into electrical contact with the metal component 90 diffused toward a side surface of the laminated inductor element, and causes unintended short circuits.

In view of this, the laminated inductor element of the present preferred embodiment is configured to significantly reduce or prevent the warpage of the entire element with a structure in which the non-magnetic ferrite layer 11 on the upper surface side is reduced in thickness to achieve a reduction in height of the entire element, the non-magnetic ferrite layer 15 on the lower surface side is increased in thickness to be thicker than the non-magnetic ferrite layer 11 and thus significantly reduce or prevent the possibility of the metal component diffused from the magnetic ferrite layer 14 coming into contact with a land electrode of the mounting substrate, and the inductor 31 is disposed toward the lower surface side across the non-magnetic ferrite layer 13.

To change the thickness of each of the layers, the number of ceramic green sheets to be laminated is changed, or ceramic green sheets of different thicknesses are used, for example.

In the present preferred embodiment, description is made of a non-limiting example which preferably uses a ferrite containing iron, nickel, zinc, and copper as the magnetic ferrite layers, uses a ferrite containing iron, zinc, and copper as the non-magnetic ferrite layers, and uses a silver material as internal wiring lines including the inductor 31. In this case, the thermal shrinkage rate of the magnetic ferrite layers is higher than the thermal shrinkage rate of the non-magnetic ferrite layers, and the inductor 31 has the lowest thermal shrinkage rate. With a preferred embodiment including the inductor 31 disposed toward the lower surface side across the non-magnetic layer 13, therefore, it is possible to prevent the warpage of the entire element. A preferred embodiment including the inductor 31 disposed conversely toward the upper surface side across the non-magnetic ferrite layer 13 is also conceivable, depending on the difference in materials (difference in thermal shrinkage rate). In either case, it is possible to prevent the warpage of the entire element, if the present preferred embodiment is configured such that the non-magnetic ferrite layer of the outermost layer on one surface side and the non-magnetic ferrite layer of the outermost layer on the other surface side are different in thickness, and that the inductor 31 is disposed toward either one of the surface sides in the lamination direction across the non-magnetic ferrite layer 13.

Herein, to dispose the inductor 31 toward the lower surface side across the non-magnetic ferrite layer 13, the present preferred embodiment is configured such that the non-magnetic ferrite layer 13 is disposed at the center, and that the inductor 31 is disposed toward the lower surface side, as illustrated in FIG. 1A, for example. In this case, the inductor 31 is disposed relatively toward the lower surface side across the non-magnetic ferrite layer 13, and it is possible to prevent the warpage of the entire element.

Figure 1B:
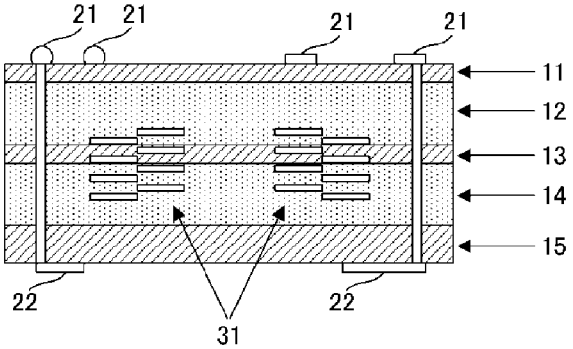

Meanwhile, a laminated inductor element illustrated in FIG. 1B is a preferred embodiment which is similar in configuration to the laminated inductor element illustrated in FIG. 1A, but in which the inductor 31 is symmetrically disposed in the lamination direction, and the non-magnetic ferrite layer 13 is disposed toward the upper surface side. Also in this case, the inductor 31 is disposed relatively toward the lower surface side across the non-magnetic ferrite layer 13, and it is possible to prevent the warpage of the entire element.

Figure 1C:
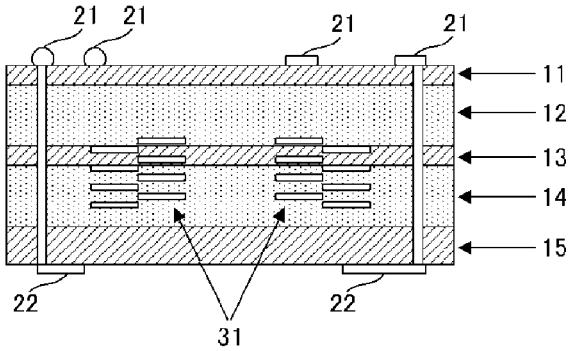

Further, a laminated inductor element illustrated in FIG. 1C is a preferred embodiment which is also similar in configuration to the laminated inductor element illustrated in FIG. 1A, but in which the inductor 31 is disposed toward the lower surface side, and the non-magnetic ferrite layer 13 is disposed toward the upper surface side. Also in this case, the inductor 31 is disposed relatively toward the lower surface side across the non-magnetic ferrite layer 13, and it is possible to prevent the warpage of the entire element.

Figure 3:
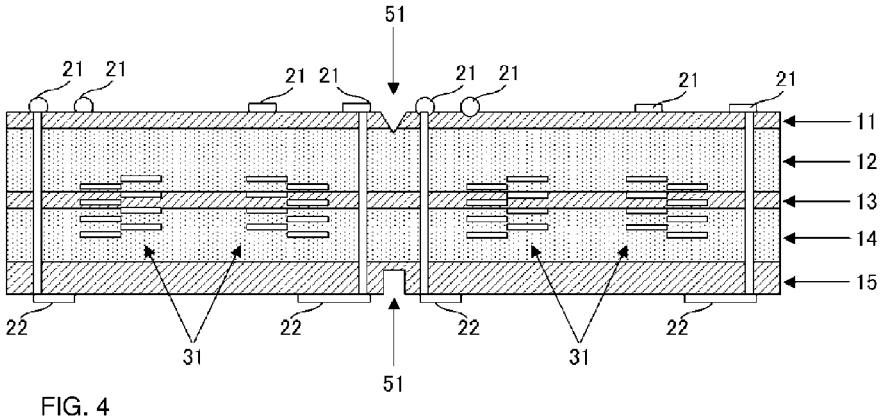
FIG. 3 is a cross-sectional view of pre-break laminated inductor elements.

Subsequently, description will be made of pre-break laminated inductor elements. FIG. 3 is a cross-sectional view of the pre-break laminated inductor elements (a mother laminate). The drawing illustrates a cross-sectional view of two adjacent pre-break chips for the purpose of explanation. In fact, however, a larger number of chips are arranged.

As illustrated in FIG. 3, the pre-break mother laminate includes grooves 51 in the upper surface and the lower surface thereof by a dicing process to make the mother laminate breakable into chips of a predetermined size at the shipping destination. The breaking grooves 51 on the upper surface side preferably are V-shaped or substantially V-shaped grooves, and the breaking grooves 51 on the lower surface side preferably are rectangular or substantially rectangular grooves. It is possible to break the mother laminate into chips by bending the mother laminate with the V-shaped or substantially V-shaped breaking grooves and the rectangular or substantially rectangular breaking grooves facing outside and inside, respectively.

Herein, the non-magnetic ferrite layer 15, which is the thicker one of the non-magnetic ferrite layers of the outermost layers, is thicker than the depth of the grooves 51. If the non-magnetic ferrite layer 15 is thus thicker than the depth of the grooves 51, the magnetic ferrite layer is not exposed to the lower surface, and the metal component is not diffused.

Figure 4:
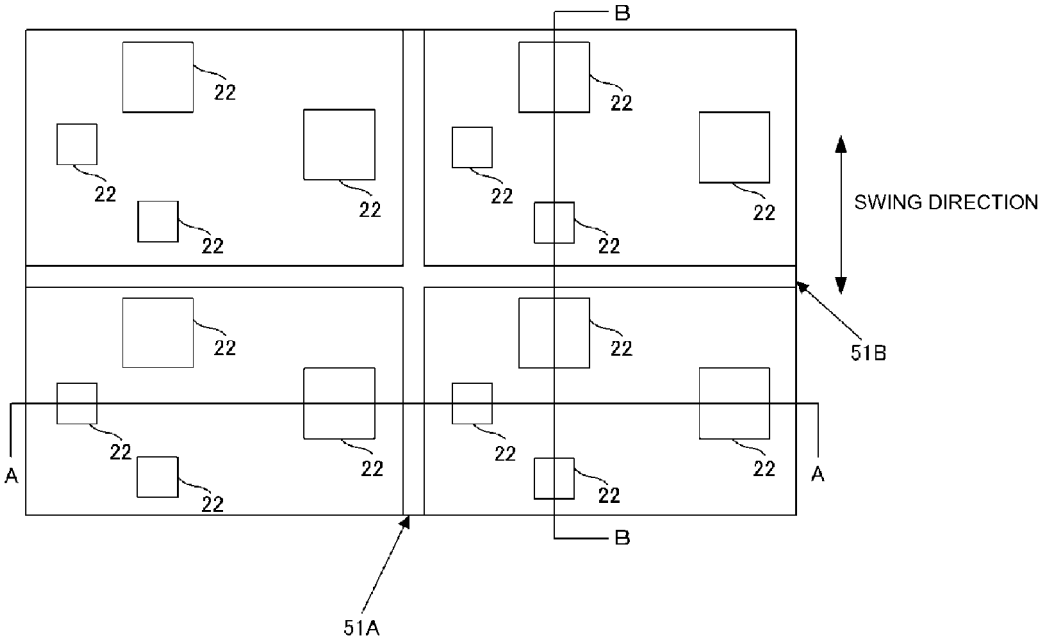
FIG. 4 is a bottom view of the pre-break laminated inductor elements.

Further, as illustrated in a bottom view of FIG. 4, the breaking grooves are provided along two mutually perpendicular or substantially perpendicular directions. That is, a groove 51A in the same direction as the direction of swinging the mother laminate in the plating process and a groove 51B in a direction perpendicular or substantially perpendicular to the swing direction are provided.

Since the groove 51A is provided in the same direction as the swing direction in the plating process, the swinging movement does not cause a plating solution to spill out of the groove and stagnate, and thus the diffused metal component is not easily grown by plating. In the groove 51B, however, the plating solution tends to stagnate, and thus the diffused metal component is easily grown by plating.

Figure 5A:
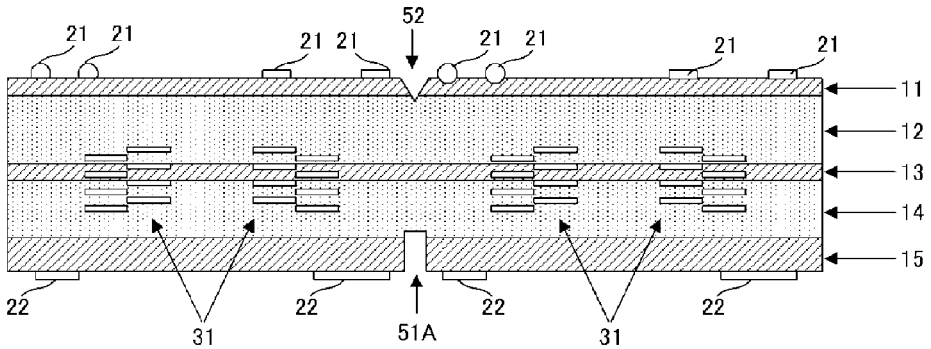
FIGS. 5A and 5B are cross-sectional view along an A-A line and a cross-sectional view along a B-B line of the pre-break laminated inductor elements.
Figure 5B:
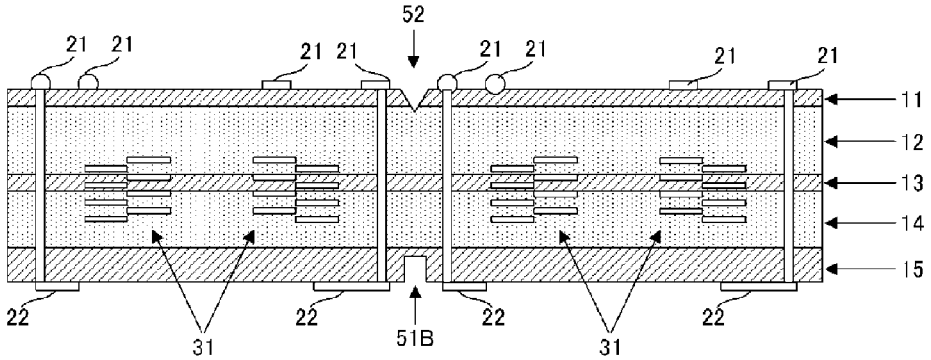

In view of this, the groove 51A provided in the same direction as the swing direction is made deep, and the groove 51B provided in the direction perpendicular or substantially perpendicular to the swing direction is made shallow, as illustrated in a cross-sectional view in FIG. 5A along an A-A line and a cross-sectional view in FIG. 5B along a B-B line. Since the plating solution does not stagnate in the groove 51A, the diffused metal component is not easily grown by plating, even if the non-magnetic ferrite layer 15 is thinner than the depth of the groove 51A, and if the magnetic ferrite layer 14 is exposed. As illustrated in FIG. 5B, therefore, it suffices if the non-magnetic ferrite layer 15 is thicker than the groove 51B. Accordingly, it is possible to reduce the thickness of the non-magnetic ferrite layer 15 as much as possible.

Subsequently, description will be made of a process of manufacturing the laminated inductor element. The laminated inductor element is manufactured by the following process.

An alloy (a conductive paste) containing Ag and so forth is first applied onto each of the ceramic green sheets to define the magnetic ferrite layers and the non-magnetic ferrite layers, and the internal electrodes such as the coil patterns are formed.

Then, the ceramic green sheets are laminated. That is, a plurality of ceramic green sheets to define the non-magnetic ferrite layer 15, a plurality of ceramic green sheets to define the magnetic ferrite layer 14, a plurality of ceramic green sheets to define the non-magnetic ferrite layer 13, a plurality of ceramic green sheets to define the magnetic ferrite layer 12, and a plurality of ceramic green sheets to define the non-magnetic ferrite layer 11 are sequentially laminated from the lower surface side, and are subjected to temporary pressure-bonding. As a result, a pre-firing mother laminate is formed.

At this stage, the number of the ceramic green sheets or the thickness of each of the sheets is adjusted to adjust the thickness of each of the layers. The ceramic green sheets to define the non-magnetic ferrite layer 15 are increased in number or thickness. Further, the ceramic green sheets to define the non-magnetic ferrite layer 11 are reduced in number or thickness.

Herein, the non-magnetic ferrite layer 15 is adjusted to be thicker than the depth of the breaking grooves. Specifically, the breaking grooves are provided along two mutually perpendicular or substantially perpendicular directions to be different in depth in a later-described groove forming process. In the process, the non-magnetic ferrite layer 15 is adjusted in thickness to be thicker than the shallower one of the breaking grooves.

Further, in the case of manufacturing the laminated inductor element having the structure illustrated in FIG. 1A, the ceramic green sheets provided with the coil patterns are disposed toward the lower surface side. It is thus possible to achieve a reduction in height of the entire element, reduce the possibility of the metal component diffused from the magnetic ferrite layer 14 coming into contact with a land electrode of a mounting substrate, and prevent the warpage of the entire element.

Further, in the case of manufacturing the laminated inductor element having the structure illustrated in FIG. 1B, the ceramic green sheets provided with the coil patterns are symmetrically disposed in the lamination direction, and the ceramic green sheets to define the non-magnetic ferrite layer 13 are disposed toward the upper surface side. In the case of manufacturing the laminated inductor element having the structure illustrated in FIG. 1C, the ceramic green sheets provided with the coil patterns are disposed toward the lower surface side, and the ceramic green sheets to define the non-magnetic ferrite layer 13 are disposed toward the upper surface side.

Then, an electrode paste containing silver as a main component is applied to surfaces of the formed mother laminate, and the outer electrodes 21 and the terminal electrodes 22 are formed.

Thereafter, the breaking grooves are formed by a dicing process to make the mother laminate breakable in a predetermined size. As illustrated in FIGS. 4 and 5, the breaking grooves are provided along two mutually perpendicular or substantially perpendicular directions. In this process, the grooves in one of the directions and the grooves in the other direction are made different in depth. This is for breaking the mother laminate at the deep grooves in the first breaking process to prevent a break in an unintended direction.

Then, firing is performed. As a result, a fired mother laminate (pre-break laminated inductor elements) is obtained.

Then, finally, respective surfaces of outer electrodes of the mother laminate are plated. The plating process is performed by immersing and swinging the mother laminate in a plating solution. In this process, the mother laminate is swung in the direction in which the deep grooves are formed. As illustrated in FIG. 5A, the non-magnetic ferrite layer 15 may be adjusted in thickness to be thicker than the shallower grooves, and may be thinner than the deeper grooves. If the direction in which the deeper grooves are formed and the swing direction of the mother laminate are matched with each other, however, the plating solution does not stagnate in the grooves, and the diffused metal component is not grown by plating. The thus manufactured laminated inductor element defines an electronic component module, when mounted with electronic components, such as an IC and a capacitor.

In the present preferred embodiment, description has been made of a non-limiting example including one intermediate layer corresponding to the non-magnetic ferrite layer 13. The intermediate layer, however, is not required to be one layer. For example, as illustrated in FIG. 6, a preferred embodiment of the present invention may be configured to dispose two intermediate layers of a non-magnetic ferrite layer 13A and a non-magnetic ferrite layer 13B, or dispose a larger number of intermediate layers.

Figure 6:
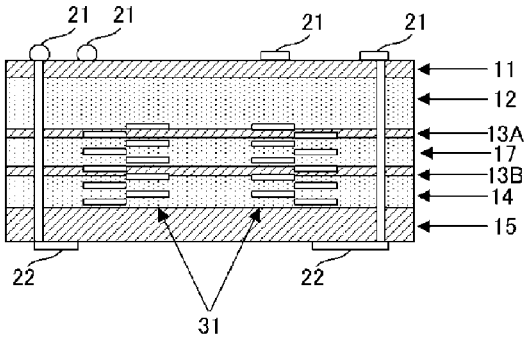
FIG. 6 is a cross-sectional view of a laminated inductor including a plurality of intermediate layers disposed therein.

Also in the case where a plurality of intermediate layers are provided, as in FIG. 6, it is possible to prevent the warpage of the entire element, if the present preferred embodiment is configured such that the non-magnetic ferrite layer of the outermost layer on one surface side and the non-magnetic ferrite layer of the outermost layer on the other surface side are different in thickness, and that the inductor 31 is disposed toward either one of the surface sides in the lamination direction across a non-magnetic ferrite layer corresponding to an intermediate layer.

For example, when the magnetic ferrite layer 12, the non-magnetic ferrite layer 13, and a magnetic ferrite layer 17 are sequentially referred to from the upper surface side, the coil patterns disposed in the magnetic ferrite layer 17 on the lower surface side of the non-magnetic ferrite layer 13A are larger in number than the coil patterns disposed in the magnetic ferrite layer 12 on the upper surface side of the non-magnetic ferrite layer 13A. This configuration, therefore, corresponds to the preferred embodiment including the inductor 31 disposed toward either one of the surface sides across a non-magnetic ferrite layer corresponding to an intermediate layer. Similarly, when the magnetic ferrite layer 17, the non-magnetic ferrite layer 13B, and the magnetic ferrite layer 14 are sequentially referred to from the upper surface side, the coil patterns disposed in the magnetic ferrite layer 14 on the lower surface side of the non-magnetic ferrite layer 13B are larger in number than the coil patterns disposed in the magnetic ferrite layer 17 on the upper surface side of the non-magnetic ferrite layer 13B. This configuration, therefore, corresponds to the preferred embodiment including the inductor 31 disposed toward either one of the surface sides across a non-magnetic ferrite layer corresponding to an intermediate layer.

If the preferred embodiment is configured, as described above, such that the inductor is disposed toward either one of the surface sides in the lamination direction across each of the intermediate layers (non-magnetic ferrite layers), it is possible to prevent the warpage of the entire element.

Also in the case of disposing a plurality of intermediate layers, the case of disposing the inductor toward the lower surface side and the case of disposing the inductor conversely toward the upper surface side are conceivable, depending on the difference in thermal shrinkage rate among the layers.

Figure 7:
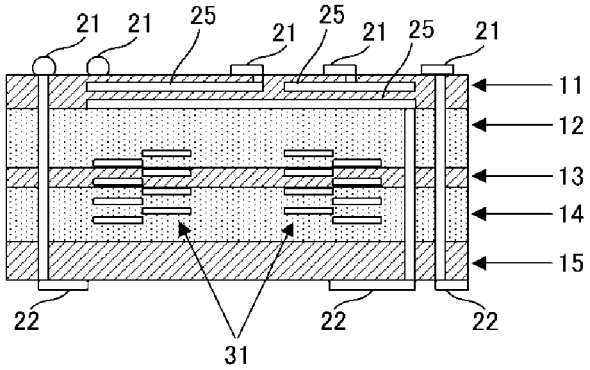
FIG. 7 is a cross-sectional view of a laminated inductor element according to an application example.

The laminated inductor element of the present preferred embodiment may also be configured as an application example in which internal electrodes 25 are provided in the non-magnetic ferrite layer 11 to have a capacitor built in the element, as illustrated in FIG. 7. That is, if the plurality of internal electrodes 25 are provided on the respective substrates of the non-magnetic ferrite layer 11 and disposed to face one another in the non-magnetic ferrite layer 11, as illustrated in FIG. 7, the facing internal electrodes 25 define a capacitor.

Although FIG. 7 illustrates the example in which a capacitor is built in the element of the preferred embodiment illustrated in FIG. 1A, a capacitor may also be built in the elements of the preferred embodiments illustrated in FIG. 1B and FIG. 1C, and in the element of the preferred embodiment illustrated in FIG. 6.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A laminated inductor element comprising:

a plurality of magnetic layers each defined by a lamination of a plurality of magnetic sheets;

a plurality of non-magnetic layers each defined by a lamination of a plurality of non-magnetic sheets; and an inductor including coils provided between the sheets and connected in a lamination direction; wherein the non-magnetic layers define outermost layers and an intermediate layer of the laminated inductor element;

the non-magnetic layer on the outermost layer on a first surface side is thinner than the non-magnetic layer on the outermost layer on a second surface side; and a distance between an uppermost surface of the inductor and a surface of the laminated inductor element on the first surface side is greater than a distance between a lowermost surface of the inductor and a surface of the laminated inductor element on the second surface side.

2. The laminated inductor element described in claim 1, wherein the first surface side is mounted with an electronic component defining an electronic component module, and the second surface side is provided with a terminal electrode to be connected to a land electrode of a mounting substrate which is mounted with the electronic component module.

3. The laminated inductor element described in claim 1, further comprising internal electrodes on the plurality of non-magnetic sheets that define a capacitor in at least one of the non-magnetic layers.

4. The laminated inductor element described in claim 1, wherein the inductor is disposed toward the second surface side in the lamination direction across the non-magnetic layer defining the intermediate layer.

5. The laminated inductor element described in claim 1, wherein the non-magnetic layer defining the intermediate layer is disposed toward either one of the first and second surface sides in the lamination direction.

6. The laminated inductor element described in claim 1, wherein a thicker one of the non-magnetic layers on the outermost layers is thicker than a depth of breaking grooves.

7. The laminated inductor element described in claim 6, wherein the breaking grooves are arranged along two mutually perpendicular or substantially perpendicular directions, and are different in depth between the two directions; and the thicker one of the non-magnetic layers is thicker than the depth of the shallower ones of the grooves.

8. The laminated inductor element described in claim 1, wherein the magnetic material is a ferrite containing iron, nickel, zinc, and copper;

the non-magnetic material is a ferrite containing iron, zinc, and copper;

the inductor includes a silver material.

9. The laminated inductor element described in claim 1, wherein the magnetic layers and the non-magnetic layers are sequentially disposed from the outermost layer on an upper surface side toward the outermost layer on a lower surface side in an order of a first non-magnetic layer, a first magnetic layer, a second non-magnetic layer, a second magnetic layer, and a third non-magnetic layer.

10. The laminated inductor element described in claim 9, wherein the second non-magnetic layer defines a gap between the first magnetic layer and the second magnetic layer.

11. The laminated inductor element described in claim 9, wherein the first non-magnetic layer and the third non-magnetic layer are lower in thermal shrinkage rate than the first magnetic layer and the second magnetic layer.

* * * * *